US006260601B1

(12) United States Patent
Thomas

(10) Patent No.: US 6,260,601 B1
(45) **Date of Patent: *Jul. 17, 2001**

(54) WIND-RESISTANT COILING DOOR

(75) Inventor: Gordon D. Thomas, Cincinnati, OH (US)

(73) Assignee: Clopay Building Products R&D Company, Inc., Cincinnati, OH (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/471,790

(22) Filed: Dec. 23, 1999

(51) Int. Cl.[7] ..... E06B 9/08
(52) U.S. Cl. ..... 160/133; 160/273.1
(58) Field of Search ..... 160/133, 273.1, 160/270, 271, 272, 32, 207, 405

(56) References Cited

U.S. PATENT DOCUMENTS

| | | | | |
|---|---|---|---|---|
| 1,246,570 | | 11/1917 | Edwards . | |
| 1,281,571 | | 10/1918 | Holt . | |
| 1,485,324 | | 2/1924 | Yerly . | |
| 1,549,714 | | 8/1925 | Claveria . | |
| 2,229,472 | | 1/1941 | Raven . | |
| 2,839,135 | * | 6/1958 | Anderson | 160/133 |
| 3,231,005 | | 1/1966 | Cookson et al. . | |
| 3,489,200 | * | 1/1970 | Recchione | 160/133 |
| 4,077,330 | | 3/1978 | Peisner et al. . | |
| 4,785,494 | | 11/1988 | Adamski . | |
| 4,889,381 | | 12/1989 | Tamblyn et al. . | |
| 4,890,354 | | 1/1990 | Cooper . | |
| 5,025,847 | | 6/1991 | Mueller . | |
| 5,253,694 | | 10/1993 | Bernardo . | |
| 5,477,902 | | 12/1995 | Kraeutler . | |
| 5,484,007 | | 1/1996 | Rejc . | |
| 5,488,982 | | 2/1996 | Rejc . | |
| 5,657,805 | * | 8/1997 | Magro | 160/133 |
| 5,839,493 | | 11/1998 | Quasius . | |
| 5,848,631 | | 12/1998 | DeGiovanni et al. . | |

FOREIGN PATENT DOCUMENTS

| | | |
|---|---|---|
| 9305852 | 8/1993 | (DE) . |
| 0143712 | 5/1985 | (EP) . |

* cited by examiner

*Primary Examiner*—David M. Purol
(74) *Attorney, Agent, or Firm*—Wood, Herron & Evans, L.L.P.

(57) ABSTRACT

A coiling door particularly useful for high wind load conditions includes roller assemblies which are captured in guides along lateral side edges of the door to minimize the drag and friction of the door during operation. As such, the coiling door is operable even under high wind load conditions for movement to and between closed positions because of the roller arrangement coupling the lateral side edges of the door to guides mounted along the sides of the door opening.

15 Claims, 4 Drawing Sheets

WIND-RESISTANT COILING DOOR

BACKGROUND OF THE INVENTION

The present invention relates generally to movable closures and, more particularly, to overhead coiling doors, rolling gates and the like.

Closure devices for protecting openings in building structures, such as doors and windows, are frequently relied upon not only to provide security for the building structure by preventing unauthorized access to the structure, but are frequently also relied upon to protect the structure from natural climatic conditions.

One approach to minimize the effects of weather has been to use rolling, coiling and/or slatted doors or shades for the door and window openings in the building. In one form, such closures are selectively rolled up in a coil at the top of the opening and unrolled to cover the entire opening. Such systems typically include an assembly of interlocking plastic or metal slats disposed between a pair of guideways attached to opposite sides of the port or opening and the assembly is stored in a rolled-up or coiled position when the port is to be open. The slats must be allowed to freely slide along the guide tracks to a closed or open position.

These rolling closures typically flex or bend when subjected to positive or negative pressures or wind loads on the outside of the structure. Such bending and flexing of the slats effectively shorten the lengths of these slats by moving the lateral ends inwardly. This problem is particularly prevalent for larger width doors, on the order of 24 feet or so.

Some known designs have attempted to limit the lateral inward movement of the ends of the slats with detents, locks, clamps or the like to thereby prevent excessive bowing or flexing of the slats. The doors and the like are not operable under such conditions because of the increased drag and friction at the lateral ends of the slats contained in guideways surrounding the door opening, window or the like.

One alternative to minimizing or preventing the flexing or bowing of the slats is to reinforce the slats to resist the wind loads. However, reinforcing techniques often result in more expensive or heavier closures which are more difficult to easily raise and lower as desired.

As a result, there is a need for a rolling or coiling closure which is a door, shutter or the like that is capable of withstanding severe climatic conditions, increased wind loads and other forces while still being operable for movement to and between closed positions under such conditions. Further, the closure system must be economically feasible without adding significant cost, weight or other detrimental features to the design.

SUMMARY OF THE INVENTION

These and other objectives of the invention have been obtained by a new and improved coiling door, shutter or the like which is highly resistant to increased wind loads while still being operable under such conditions. The present invention is particularly directed to coiling commercial doors and the like for application in high wind load conditions. Standard coiling doors can only be operated under very low wind load conditions, typically on the order of five lbs. per square feet or less because of the increased drag and friction on the guides or guideways along the door opening at each lateral side of the door.

This invention allows for large width doors, on the order of up to 24 feet or so, to operate under higher wind loads, typically on the order of 35 lbs. per square feet or so. The coiling door includes a number of pivotally coupled slats which extend laterally across the door opening, window opening or the like. The invention includes an arrangement of roller assemblies which include rollers on each lateral end of the door. The rollers are each mounted on an axle which is supported on a roller mount that is bolted, screwed or otherwise secured on to the lateral end of the respective slat. The rollers are positioned in guides which extend vertically along the lateral sides of the door opening.

The rollers are positioned on adjacent slats of the coiling door such that each grouping of three slats includes an upper and a lower roller which are each oriented with a rotation axis generally parallel to the plane of the coiling door and are on opposite sides of a third roller which rotates on an axis generally perpendicularly to the plane of the garage door. The center roller in each grouping is positioned proximate the front face or back face of the door and the next adjacent grouping of three rollers, with the intermediate roller having its axis perpendicular to the plane of the door, is alternately positioned relative to the front or back face of the door.

In one embodiment, the guides include a pair of spaced guide arms between which the roller assemblies and the lateral ends of the slats are positioned. The guide arms include confronting inner surfaces which are adapted for rolling contact with the rollers having their axis positioned generally parallel to the faces of the door. The guides also include a retainer which captures each of the rollers that have their axis perpendicular to the face of the door. The retainer captures these rollers in the guide so that under wind load conditions, the rollers inhibit excessive bowing or flexing of the door and prevent the lateral ends of the slats from escaping the guides. However, the door can still be opened or closed even under high wind load conditions because the rollers are mounted for rotation along the retainers and the confronting faces of the guides so that the drag and friction during movement of the door is minimized. The rollers assist in resisting the deflection of the door by being captured in the guides while still allowing for movement of the door by rolling contact along the guides and retainers.

BRIEF DESCRIPTION OF THE DRAWINGS

The objectives and features of the invention will become more readily apparent from the following detailed description taken in conjunction with the accompanying drawings in which.

DETAILED DESCRIPTION OF THE INVENTION

Figure 1:
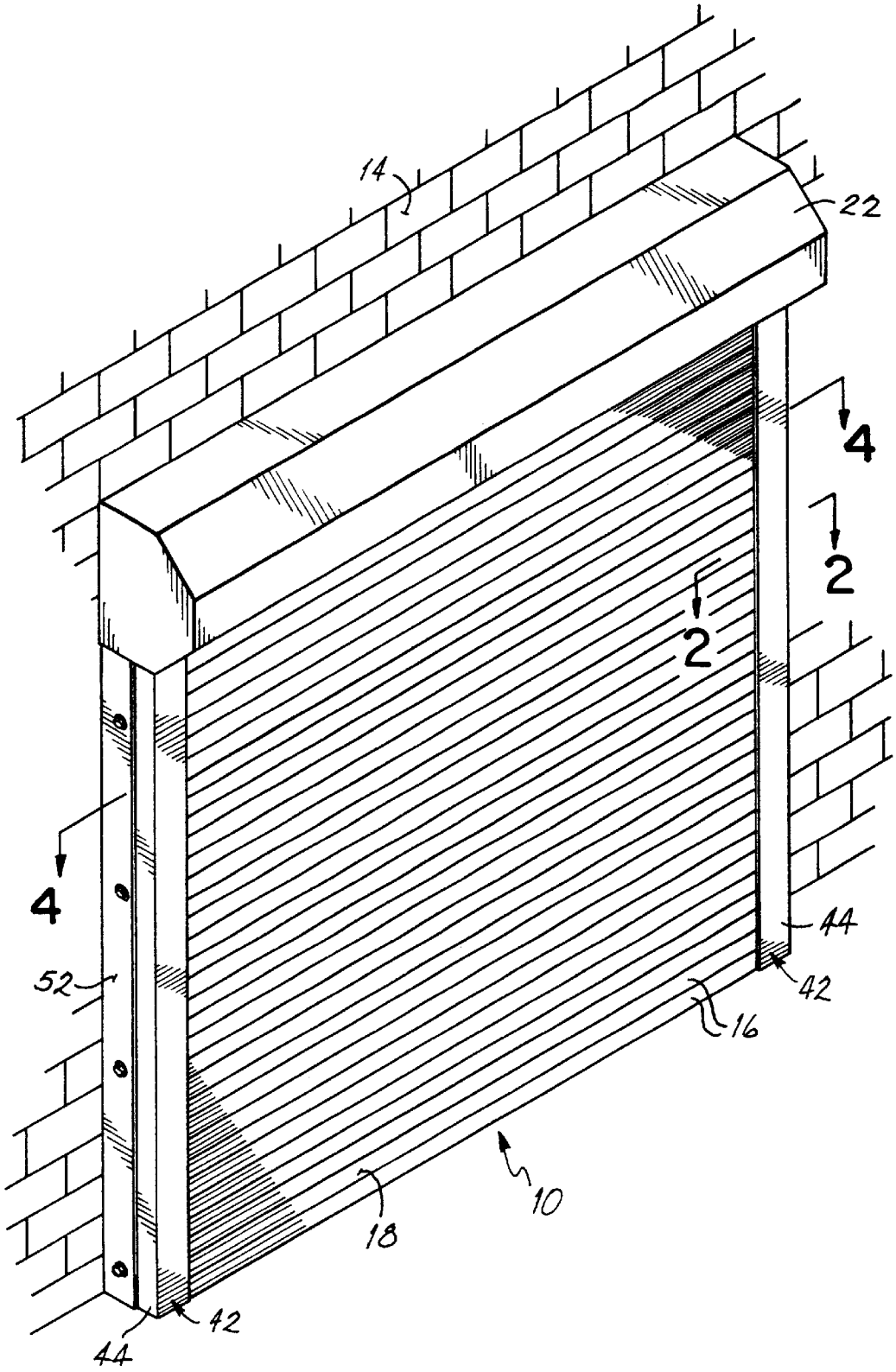
FIG. 1 is a perspective view of typical coiling door on which the present invention can be used.
Figure 2:
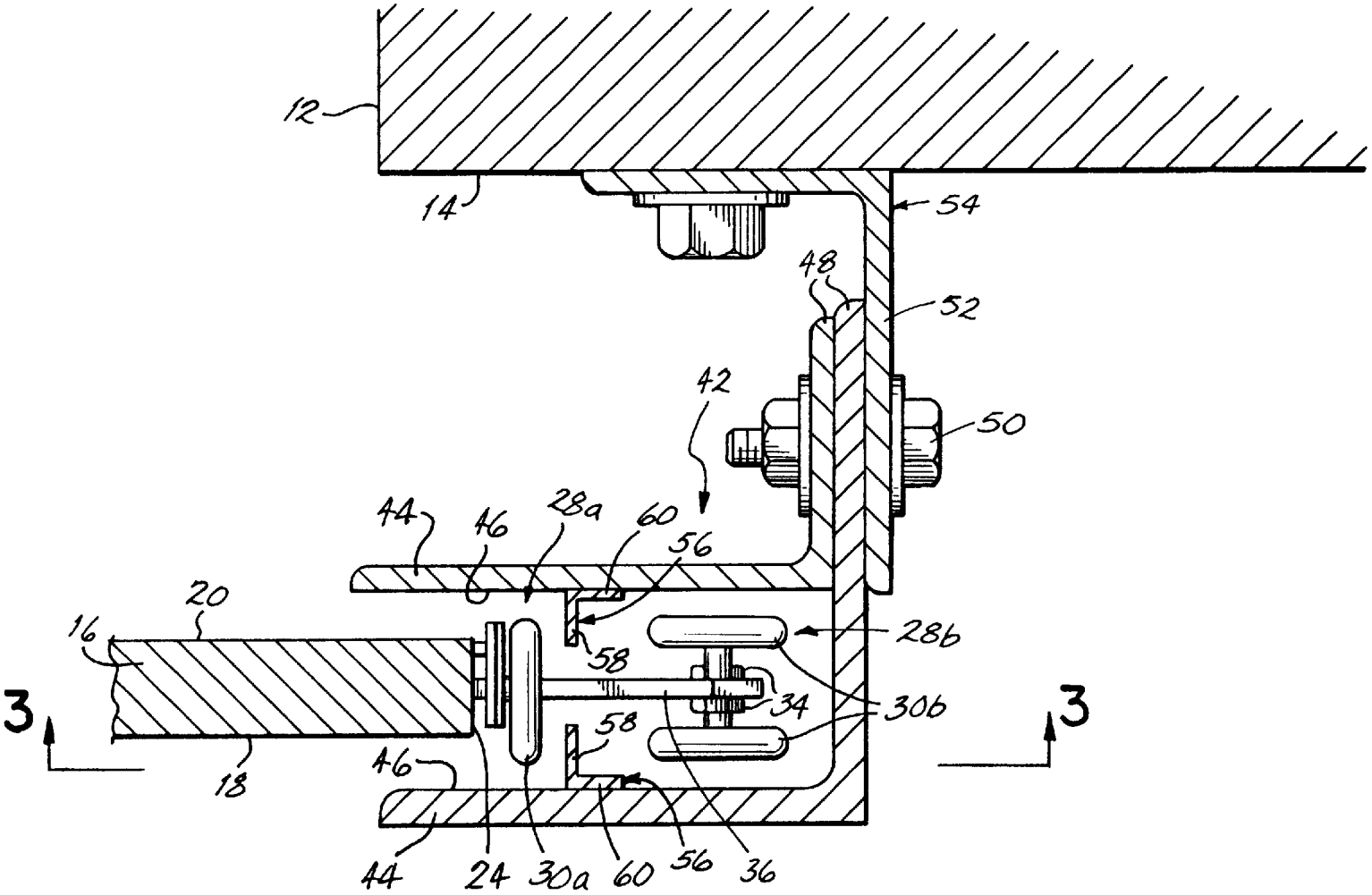
FIG. 2 is a cross-sectional view taken along line 2—2 of FIG. 1.
Figure 4:
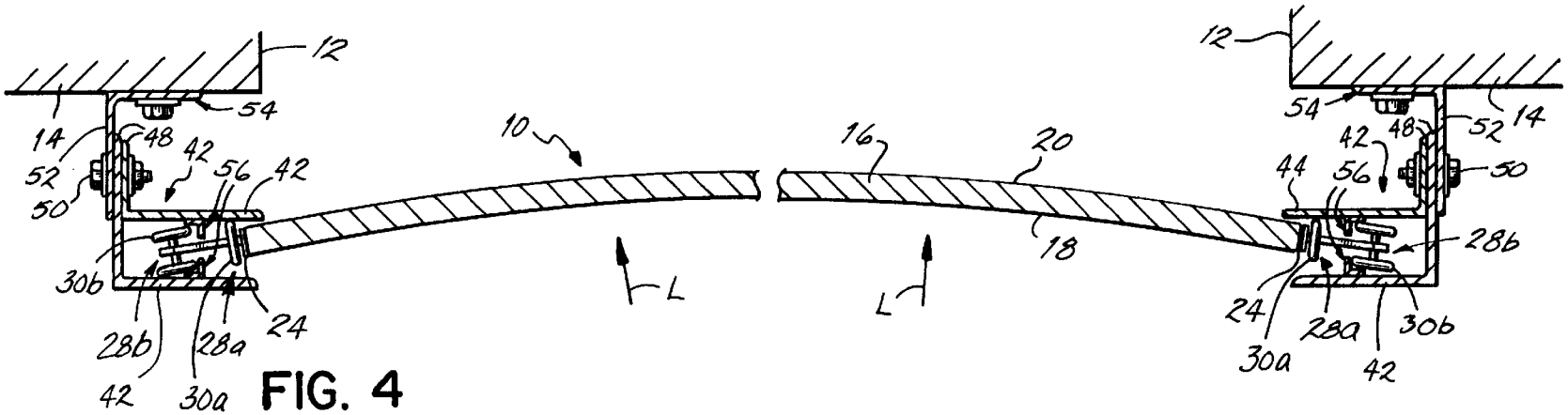
FIG. 4 is a cross-sectional view taken along line 4—4 of FIG. 1 with the door in a closed position under a wind load.

Referring to FIG. 1, one embodiment of a coiling door 10 is shown in a closed position covering a door opening 12 (FIG. 4) in a building 14. The coiling door 10 includes a number of laterally extending sections or slats 16 all of which are coupled together for pivotal movement relative to the adjacent section or slat. The slats 16 combine to define a front face 18 of the door 10, as shown in FIG. 1, and a back face 20 (FIGS. 2 and 4). The coiling door 10 as shown in FIG. 1 and as is well known of closures of this type can be selectively raised toward an open position exposing the door opening 12 by coiling or rolling the slats 16 around a rotationally motor driven shaft (not shown) positioned atop the door opening 12. The raised and coiled door 10, shaft and related structure are enclosed in an upper cover 22.

Figure 3:
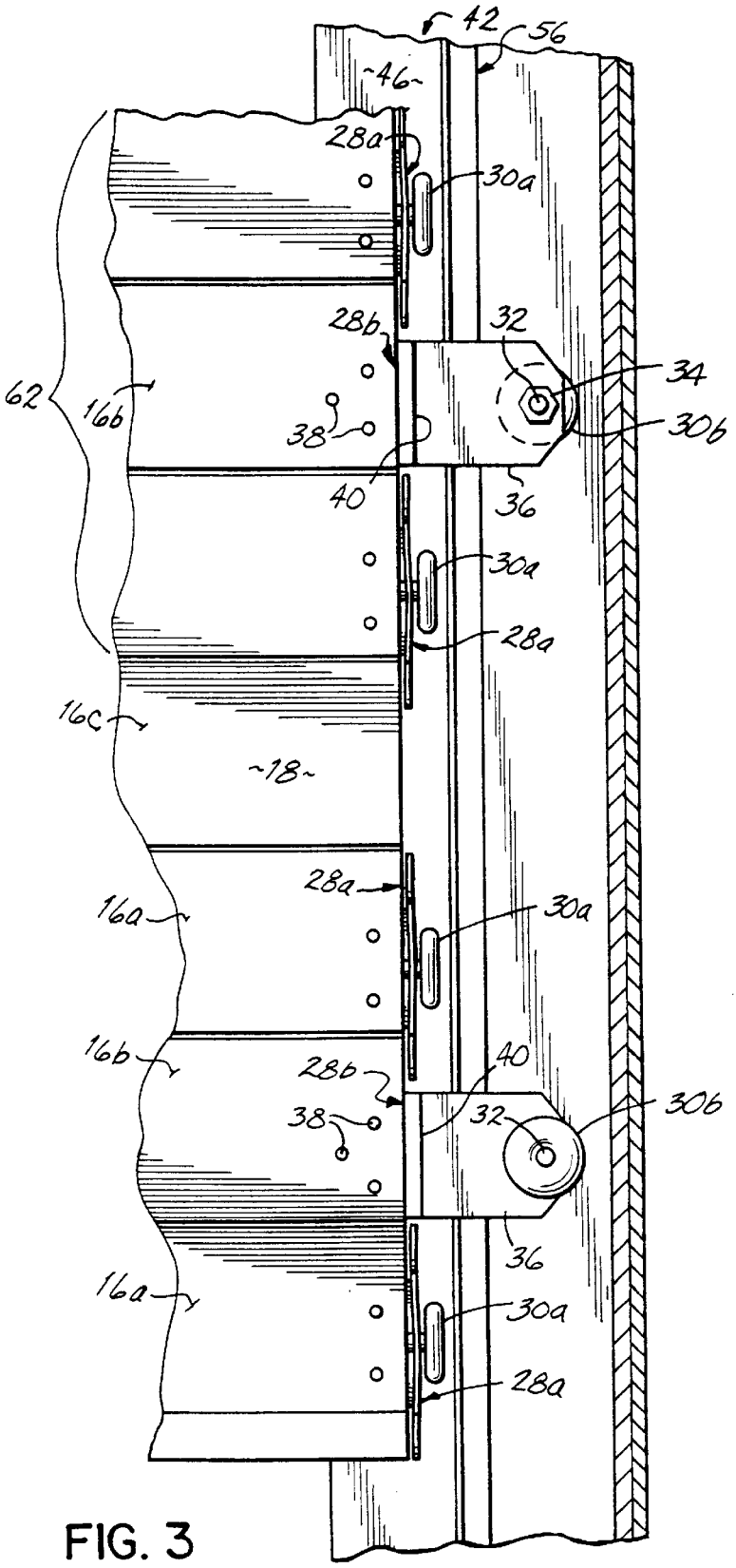
FIG. 3 is a cross-sectional view taken along line 3—3 of FIG. 2.

Referring to FIGS. 2–3, one embodiment of this invention includes roller assemblies 28 mounted to the lateral ends 24 of selected slats 16 of the coiling door 10 and extending outwardly therefrom. Particularly, the roller assemblies 28 include a preferably steel roller 30 mounted on an axle 32, secured by a hex nut 34 or the like to a roller mounting plate 36. The roller mounting plate 36 is bolted, riveted, screwed or otherwise secured with a mechanical fastener 38 or the like to the lateral end 24 of the associated slat 16. In one embodiment of this invention, a first set 28*a* of the roller assemblies 28 each have the rollers 30*a* mounted for rotation about an axis which is generally parallel to the front and back faces 18, 20 of the door 10, as shown particularly in FIGS. 2 and 3. Alternatively, a second set 28*b* of the roller assemblies 28 each have the rollers 30*b* mounted for rotation on axes generally perpendicular to the front and back faces 18, 20 of the door 10. More specifically, selected rollers 30*b* of the second set 28*b* are positioned proximate the front face 18 of the coiling door 10 while other rollers of the second set 28*b* have the rollers 30*b* positioned proximate the back face 20 of the door 10. The positioning of the respective rollers 30*b* in the second set 28*b* is accomplished in one embodiment of this invention by an appropriately oriented jog or bend 40 in the mounting plate 36, as shown particularly in FIG. 3.

The roller assemblies 28, rollers 30 and lateral ends 24 of the slats 16 are positioned for movement within guides 42 mounted proximate the lateral sides of the door opening 12, as particularly shown in FIG. 2. In one embodiment, the guides 42 include a pair of inwardly extending spaced guide arms 44 which have confronting inwardly facing surfaces 46 upon which the rollers 30*a* in the first set 28*a* of roller assemblies are adapted for rolling contact there along. The guide arms 44 each extend perpendicularly from support legs 48, each of which are mounted by a bolt and nut or other mechanical fastener 50 to a projecting first leg 52 of an L-shaped guide mounting bracket 54 near the lateral side of the door opening 12.

A retainer 56 is also included in each guide 42 and in one embodiment includes a pair of L-shaped members mounted on the inner confronting surfaces of the guide arms 44. Each of the L-shaped retainers 56 includes an inwardly projecting race 58 which extends perpendicularly from a mounting flange 60 secured to the guide arm 44. Each race 58 is adapted for rolling contact with the rollers 30*b* of the second set 28*b* of roller assemblies. The roller assembly mounting plates 36 for the second set 28*b* of roller assemblies project between the spaced retainers 56 to thereby capture the rollers 30*b* of the second set 28*b* within the guides 42, as shown in FIG. 2. The rollers 38*a* of the first set 28*a* of roller assemblies are not captured by the retainers 56 but are positioned within the guide arms 44.

In one embodiment of this invention as shown in FIG. 3, each grouping 62 of three adjacent slats 16 includes three roller assemblies 28 mounted on the lateral ends 24 thereof. Specifically, the outermost slats 16*a* of each grouping 62 includes a roller assembly of the first set 28*a* in which the roller 28*a* is mounted on an axis generally parallel to the front or back faces 18, 20 of the door 10 and for rolling contact with the inner confronting surfaces 46 of the guide arms 44. The middle slat 16*b* of each grouping 62 of three slats has a roller assembly of the second set 28*b* with the roller 30*b* mounted for rotation about an axis generally perpendicular to the front and back faces 18, 20 of the door 10. More specifically, each grouping 62 of three slats 16 is separated from an adjacent grouping 62 of three slats by a slat 16*c* that does not include a roller assembly 28 mounted thereto. It should be understood that different arrangements and configurations of the roller assemblies from those shown and described herein can be employed within the scope of this invention depending upon the wind load conditions, door parameters and other appropriate factors.

Additionally, the roller assembly of the second set 28*b* in each grouping 62 is alternately positioned proximate the front or back face 18, 20 of the door 10 with respect to the roller assembly of the second set 28*b* in the adjacent grouping 62, as shown in FIG. 3. Furthermore, the door 10, according to one embodiment of this invention, is symmetric about a longitudinal axis so that the arrangement and positioning of the roller assemblies 28 on one lateral end 24 of the door 10 is identical to the arrangement and position of the roller assemblies 28 on the opposite lateral end 24 of the door 10, although other arrangements and positions for the roller assemblies 28 are contemplated within the scope of this invention.

Having described in detail one or more specific embodiments of this invention, the operation of the invention is illustrated in FIG. 4 in which the door 10 is shown in a bowed or flexed configuration as a result of a wind load L or other force exerted on the door 10. Movement of the door 10 to and between the closed and open positions is easily accomplished as a result of the roller assembly 28 arrangement on the door. Specifically, in the bowed or flexed configuration, the rollers 30 on each lateral end 24 of the door 10 of the first set 28*a* contact the inner surface 46 of one of the guide arms 44 for rolling contact there along to significantly reduce the friction and drag and facilitate movement of the door 10 under the wind load L or similar condition. Additionally, the rollers 30*b* of the second set 28*b*, specifically those positioned proximate the front face 18 of the door 10 with respect to the condition shown in FIG. 4, engage the race 58 of the retainer 56 to limit further inward movement of the lateral ends 24 of the door 10 because the second set 28*b* of rollers 30*b* are captured by the retainers 56, as shown in FIG. 4. Once again, unlike known doors, the rolling contact between the race 58 on the retainer 56 and the rollers 30*b* of the second set 28*b* enable movement of the door 10 to and between the closed and open positions even under high wind load or bowed conditions. The bowed or flexed condition of the door 10 is even more pronounced with wider doors. Nevertheless, the friction and drag on the door 10 is minimized with this invention, thereby maintaining operation of the door.

From the above disclosure of the general principles of the present invention and the preceding detailed description of at least one embodiment, those skilled in the art will readily comprehend the various modifications to which this invention is susceptible. Therefore, I desire to be limited only by the scope of the following claims and equivalents thereof.

I claim:

1. A door selectively movable between open and closed positions in a door opening having opposing lateral sides, the door comprising:

a plurality of laterally extending sections each of which is joined to an adjacent section and has spaced lateral ends, the sections collectively defining a front face and a back face of the door;

a roller assembly extending from the lateral ends of selected sections, each roller assembly including a roller mounted for rotation;

a plurality of roller mountings which non-pivotally join selected roller assemblies to the respective section of the door, each roller mounting having a first face directed to the front face of the door and a second face directed to the back face of the door;

wherein a first set of the rollers are mounted for rotation on axes generally parallel to the front and back faces of the door and a second set of the rollers are mounted for rotation on axes generally perpendicular to the front and back faces of the door, the selected sections each having rollers from only one of the first and second set of rollers and selected rollers of the second set being joined to selected roller mountings to extend outwardly from the first faces thereof and be positioned proximate the front face of the door and other rollers of the second set being joined to selected roller mountings to extend outwardly from the second faces thereof and be positioned proximate the back face of the door; and a pair of opposing guides each of which are mounted proximate one of the lateral sides of the door opening with one of the lateral ends of the door positioned relative thereto, each of the rollers of the roller assemblies being positioned for rolling movement relative to one of the guides as the door is moved to and between the closed and open positions.

2. The door of claim 1 wherein the guides further comprise:

a pair of spaced guide arms between which the roller assemblies are positioned, the guide arms having confronting inner surfaces which are adapted for rolling contact by the first set of rollers.

3. The door of claim 2 wherein the spaced guide arms project generally parallel to the front and back faces of the door.

4. The door of claim 1 wherein the sections are slats which are pivotally coupled together and the door is a coiling door.

5. The door of claim 1 further comprising:

a retainer positioned within the guides to capture the second set of rollers therein; and a race on the retainer which is adapted for rolling contact by the second set of rollers, wherein the second set of rollers engages the race on the retainer for rolling contact when one of the faces of the door is deflected in response to a load applied to the door.

6. The door of claim 5 wherein the first set of rollers are not captured by the retainer.

7. The door of claim 1 wherein a grouping of three adjacent sections of the door includes two rollers of the first set with one roller from the second set therebetween and each of the rollers are mounted to respective sections in the grouping of three adjacent sections.

8. The door of claim 7 wherein the roller of the second set of one grouping is proximate the front face of the door and the roller of the second set of an adjacent grouping is proximate the back face of the door.

9. A door selectively movable between open and closed positions in a door opening having opposing lateral sides, the door comprising:

a plurality of laterally extending sections each of which is pivotally coupled to an adjacent section and has spaced lateral ends, the sections collectively defining a front face and a back face of the door;

a roller assembly extending from the lateral ends of selected sections, each roller assembly including a roller mounted for rotation;

a plurality of roller mountings which non-pivotally join selected roller assemblies to the respective section of the door, each roller mounting having a first face directed to the front face of the door and a second face directed to the back face of the door;

wherein a first set of the rollers are mounted for rotation on axes generally parallel to the front and back faces of the door and a second set of the rollers are mounted for rotation on axes generally perpendicular to the front and back faces of the door, the selected sections each having rollers from only one of the first and second set of rollers and selected rollers of the second set being joined to selected roller mountings to extend outwardly from the first faces thereof and be positioned proximate the front face of the door and other rollers of the second set being joined to selected roller mountings to extend outwardly from the second faces thereof and be positioned proximate the back face of the door;

a pair of opposing guides each of which are mounted proximate one of the lateral sides of the door opening with one of the lateral ends of the door positioned therein, each of the rollers of the roller assemblies being positioned in one of the guides for rolling movement therein as the door is moved to and between the closed and open positions, each guide further including a pair of spaced guide arms between which the roller assemblies are positioned, the guide arms having confronting inner surfaces which are adapted for rolling contact by the first set of rollers; and a retainer mounted within each of the guides, the retainer capturing the second set of rollers for rolling movement therein along an outwardly oriented race on the retainer when one of the faces of the door is deflected.

10. The door of claim 9 wherein the sections are slats which are pivotally coupled together and the door is a coiling door.

11. The door of claim 9 wherein each grouping of three adjacent sections of the door includes two rollers of the first set with one roller from the second set therebetween and each of the rollers are mounted to respective sections in the grouping of three adjacent sections.

12. The door of claim 11 wherein the roller of the second set of one grouping is proximate the front face of the door and the roller of the second set of an adjacent grouping is proximate the back face of the door.

13. A method of installing a door selectively movable between open and closed positions in a door opening having opposing lateral sides, the method comprising:

mounting a pair of guides each on one of the lateral sides of the door opening;

positioning a plurality of lateral extending door sections between the guides, each of the door sections being coupled to an adjacent door section for movement relative thereto during movement of the door to and between the open and closed positions, the sections collectively defining a front face and a back face of the door;

non-pivotally joining a plurality of roller assemblies to extend from selected sections of the door, each of the roller assemblies having a roller;

inserting the plurality of roller assemblies into one of the guides;

orienting a first set of the rollers for rotation about axes generally parallel to the front and back faces of the door, the first set of rollers being oriented for rolling movement relative to one of the guides as the door is moved to and between the closed and open positions;

orienting a second set of the rollers for rotation about axes generally perpendicular to the front and back faces of the door with selected rollers of the second set positioned proximate the front face of the door and other rollers of the second set positioned proximate the back face of the door;

capturing the second set of rollers by a retainer in the guides for rolling movement thereon as the door is moved to and between the closed and open positions; and mounting each of the rollers to the lateral end of selected sections of the door such that each of the selected sections has rollers from only one of the first and second set of rollers.

14. The method of claim 13 further comprising:

arranging the roller assemblies on a grouping of three adjacent door sections with two rollers of the first set and one roller of the second set therebetween.

15. The method of claim 14 further comprising:

positioning the roller of the second set of one grouping proximate the front face of the door; and positioning the roller of the second set of an adjacent grouping proximate the back face of the door.

* * * * *